US006675723B2

(12) United States Patent
Sukeva

(10) Patent No.: US 6,675,723 B2
(45) Date of Patent: Jan. 13, 2004

(54) PALLET CAGE

(75) Inventor: Niko Sukeva, Helsinki (FI)

(73) Assignee: Modularbox Oy, Helsinki (FI)

( * ) Notice: Subject to any disclaimer, the term of this patent is extended or adjusted under 35 U.S.C. 154(b) by 0 days.

(21) Appl. No.: 10/162,886

(22) Filed: Jun. 6, 2002

(65) Prior Publication Data

US 2002/0185042 A1 Dec. 12, 2002

(30) Foreign Application Priority Data

Jun. 6, 2001 (EP) ..... 01660109

(51) Int. Cl.[7] ..... B65D 19/44
(52) U.S. Cl. ..... 108/55.1
(58) Field of Search ..... 108/55.1, 51.11, 108/56.1; 220/4.31, 4.28

(56) References Cited

U.S. PATENT DOCUMENTS

| | | | | | |
|---|---|---|---|---|---|
| 4,492,153 | A | * | 1/1985 | Grabowski | 220/4.28 |
| 4,609,116 | A | * | 9/1986 | Simms | 220/4.28 |
| 4,635,562 | A | * | 1/1987 | Kreeger | 108/55.1 |
| 4,782,972 | A | | 11/1988 | Wenkman et al. | |
| 5,078,415 | A | * | 1/1992 | Goral | 408/55.1 |
| 5,236,099 | A | * | 8/1993 | Fties et al. | 220/4.31 |
| 5,419,448 | A | * | 5/1995 | Watson | 220/4.28 |
| 5,803,295 | A | * | 9/1998 | Tussey | 220/4.31 |
| 5,816,425 | A | * | 10/1998 | Keip et al. | 220/4.31 |
| 6,131,757 | A | * | 10/2000 | Clark et al. | 220/7 |

FOREIGN PATENT DOCUMENTS

| | | | |
|---|---|---|---|
| DE | 91 10 413 | | 10/1991 |
| DE | 93 02 029 | | 4/1993 |
| DE | 42 44 713 | | 12/1993 |
| DE | 89 08 223 | | 8/1999 |
| EP | 1179488 | A2 * | 2/2002 |
| GB | 2022986 | A * | 12/1979 |
| GB | 2 333 284 | | 7/1999 |

* cited by examiner

*Primary Examiner*—Jose V. Chen
(74) *Attorney, Agent, or Firm*—Young & Thompson

(57) ABSTRACT

A pallet cage, comprising a pallet and four walls mounted on its edges, together forming a cage open above and having the shape of a rectangular parellelopiped, in which the four walls of the cage are separate castings pressed from plastic and detached from each other, two of the walls are opposite and identical side walls while the other two are opposite and identical end walls, the end wall consists of a straight, elongated and plate-like part having a joining element at each end of it, the side wall consists of a straight, elongated and plate-like part having a 90° corner part at each end of it, the outer edges of the side walls being provided with counterparts of the joining elements, the walls being connectable to each other by the joining elements and their counterparts to form the walls of a cage having the form of a right-angled parallelogram.

12 Claims, 7 Drawing Sheets

PALLET CAGE

FIELD OF THE INVENTION

The present invention relates to a pallet cage comprising a pallet and four walls supported on its edges, which together form a cage open above and having the shape of a rectangular parallelopiped.

BACKGROUND OF THE INVENTION

Pallet cages, i.e. pallets with racks supported on them, are widely used for the storage, transportation and handling of various goods and increasingly also as selling and distribution racks in retail stores. The pallets are mainly wooden structures assembled by nailing, such as FIN pallets and EURO pallets or their split halves. However, in the context of the present application, 'pallet' also refers to a straight plate, e.g. a thick plywood plate with wheels mounted under its four corners.

Prior-art pallet cage wall structures in most cases consist of plywood plates or boards joined together by various joint and hinge arrangements. The rack thus formed can be erected and supported in the shape of a right-angled parallelogram around the edges of a pallet, and after use it can be collapsed into a more compact form.

However, prior-art pallet cage structures have several drawbacks. The modular walls are heavy and difficult to handle. When collapsed, they generally take up more room in the longitudinal direction than the length of the pallet in question, so it is difficult to collect them onto pallets and return them using pallets. Moreover, because of their appearance and unhygienic nature, such wooden pallet cage structures are generally only suitable for use in storage rooms and cannot be regarded as elegant selling racks for retail stores, where they are nowadays frequently seen. Likewise, the prior-art wall structures are in many applications difficult to use because they cannot be opened or disassembled in part only, but instead it is necessary to remove a whole tier of the same height at a time from the wall structure on the pallet if the pallet cage is to be partially disassembled or if its walls are to be made lower.

Pallets provided with wheels, i.e. castor pallets, are generally provided with metal racks or metal cages. These are widely used for the transportation of goods and as selling racks in shops and also e.g. in laundries for the transportation of laundry. However, cages made of metal wire have an appearance unfit for retail purposes and they make a noise during transportation as they clatter against each other, so they are disagreeable to use.

SUMMARY OF THE INVENTION

The object of the invention is to eliminate the above-mentioned disadvantages. A specific object of the invention is to disclose a new type of pallet cage which is compact when collapsed and is easy, simple and light to assemble, has an elegant appearance and a hygienic structure regarding its material and is easy to keep clean while allowing versatile and varied alternatives of pallet cage structure for different applications.

The pallet cage of the invention comprises a traditional pallet forming the bottom of the cage, e.g. a EURO pallet, a FIN pallet or a thicker, straight plate provided with wheels, and four walls mounted on it, which together form a cage open at the top and having the shape of a rectangular parallelopiped. According to the invention, the four walls of the cage are separate castings pressed from plastic, detached from each other, two of which are opposite and identical side walls while the other two are opposite and identical end walls. The end wall consists of a straight and elongated, substantially plate-like part with joining elements at both ends of it, and the side wall consists of a straight and elongated, substantially plate-like part and a 90° corner piece at each end of it, with counterparts for the joining elements of the end walls at their outer edges. Thus, the end walls and the side walls can be connected to each other by means of the joining elements and their counterparts to form the walls of a pallet cage on a pallet.

The joining element and its counterpart preferably consist of elements movable with respect to each other in the vertical direction of the cage and latchable to each other in the horizontal direction. Thus, to connect the walls of the cage to each other, no movable or turnable parts or latches need to be operated, but only the walls are moved vertically with respect to each other so that they engage each other via appropriately shaped joining elements and their counterparts.

The castings of the invention are preferably made from HD polyethylene, but other plastic materials may also be used.

The side wall of the invention comprises at least two lugs extending downward from its lower edge, by which lugs the side wall can be held steady on and/or fastened to a pallet. The lug may be provided with a hole for a screw or nail for securing the side wall to the pallet. In its simplest form, the pallet cage of the invention consists of a pallet and two end walls and two side walls, forming a rack on top of the pallet. However, upon this rack it is possible to mount another rack and even more racks of a corresponding structure so that a pallet cage with a suitable wall height can always be obtained. Thus, in an embodiment of the invention, the lug extending downward from the lower edge of the side wall comprises at least one latching socket and the upper edge of the side wall is provided with a projecting latching clutch corresponding to the latching socket and located in a corresponding part on the outer surface. Thus, the identical side walls placed one upon the other can be locked to each other by setting them so that the latching clutch of the lower side wall goes into the latching socket of the side wall above it. Thus, the side walls being vertically exactly aligned with each other, they are locked to each other in the vertical direction.

In an embodiment of the invention, the number of latching sockets placed one above the other in the lug exceeds the number of latching clutches placed one above the other in the outer surface of the upper edge of the side wall by at least one. Thus, the side wall can be locked in at least two different height positions on another side wall. This structural alternative makes it possible to use e.g. a plate-like intermediate floor between two wall structures placed one upon the other, yet without preventing them from being latched together so as to keep them immovable in the vertical direction.

Preferably both the end wall and the side wall is provided with an angle flange extending through their essential length at their lower edge. The flange extends downward from the lower surface of the wall, allowing the walls to be accurately mounted either upon a pallet or upon corresponding other walls.

Preferably the upper edge of both the end wall and the side wall comprises a substantially horizontal top flange, upon and against which another identical end wall or side wall can be readily supported.

As compared with prior-art solutions, the pallet cage of the invention has significant advantages. The pallet cage is very rigid and durable in spite of its simple structure and the ease of its assembly and disassembly. The structure contains no moving or turning parts, but only fixed and rigid castings to be set upon the pallet. When disassembled, the components of the pallet cage do not take up much room and they can be accommodated on the pallet in question, so they can be easily transported and returned. The pallet cage can be partially disassembled or opened, i.e. some of the other end walls can be removed from it, which allows diversified application of the pallet cages even as distribution racks in shops. In addition, as compared with traditional wooden/metallic structures, the invention is superior in respect of appearance, allowing unlimited color alternatives. The entire structure is hygienic and easy to keep clean, so it can be used in a very wide range of applications, even in cases where traditional structures can not be used.

BRIEF DESCRIPTION OF THE DRAWINGS

In the following, the invention will be described in detail with reference to the attached drawings, wherein.

DETAILED DESCRIPTION OF THE INVENTION

Figure 1:
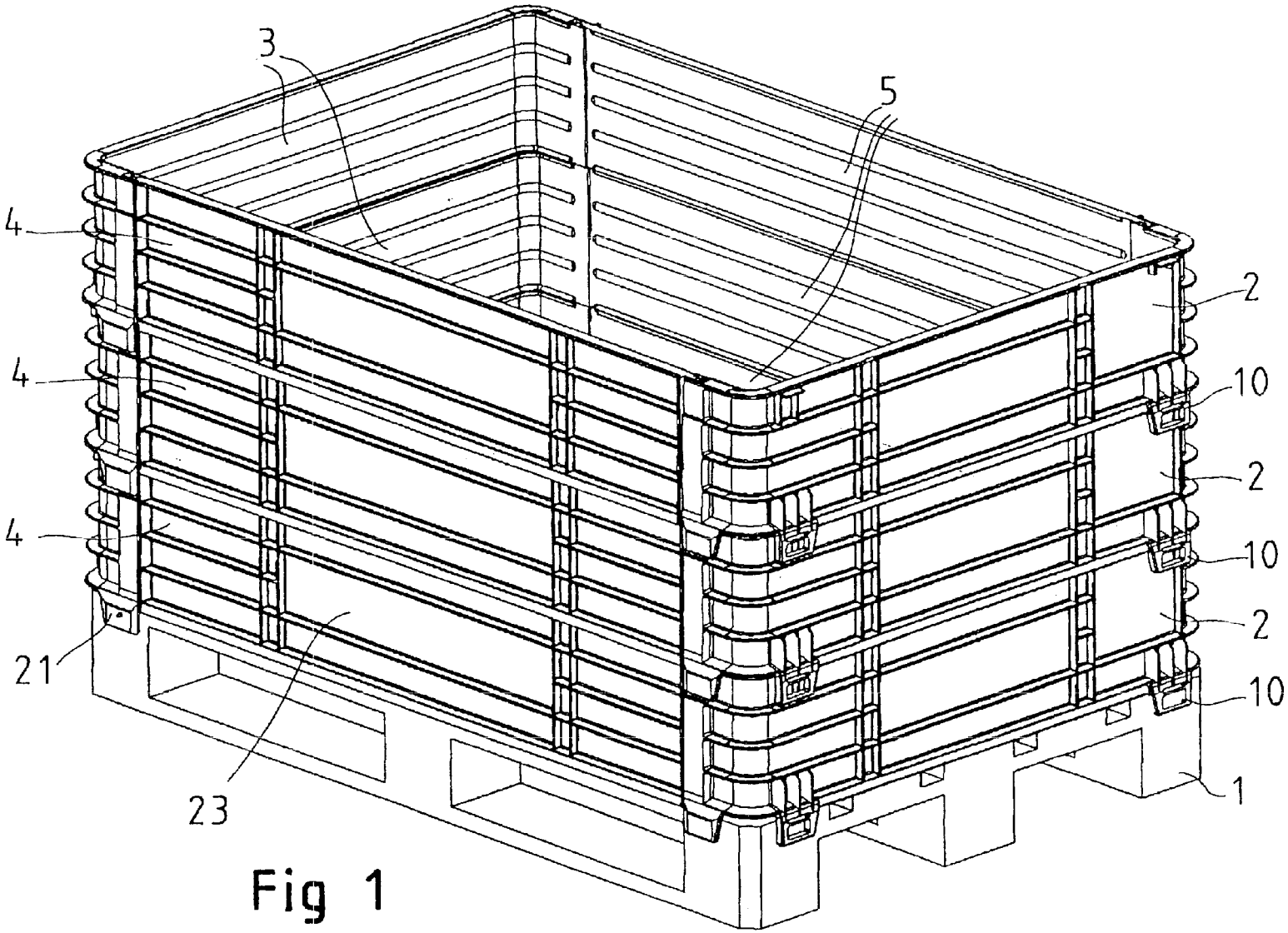
FIG. 1 presents a three-tier pallet cage according to the invention.

FIG. 1 presents a pallet cage according to the invention. It comprises a traditional, ordinary pallet 1 with three tiers of pallet cage walls according to the invention placed upon it, the opposite side walls 2 and 3 as well as the opposite end walls 4 and 5 in the bottommost tier being supported on the edge areas of the pallet 1. Each of the next corresponding wall tiers is supported on the previous identical wall structure below it. Thus, the height of the pallet cage can always be selected as necessary in each case to suit the goods to be transported or stored in it.

In the following, the structures of the walls 2–5 of the pallet cage shown in FIG. 1 will be described in detail with reference to FIGS. 2–5.

Figure 2:
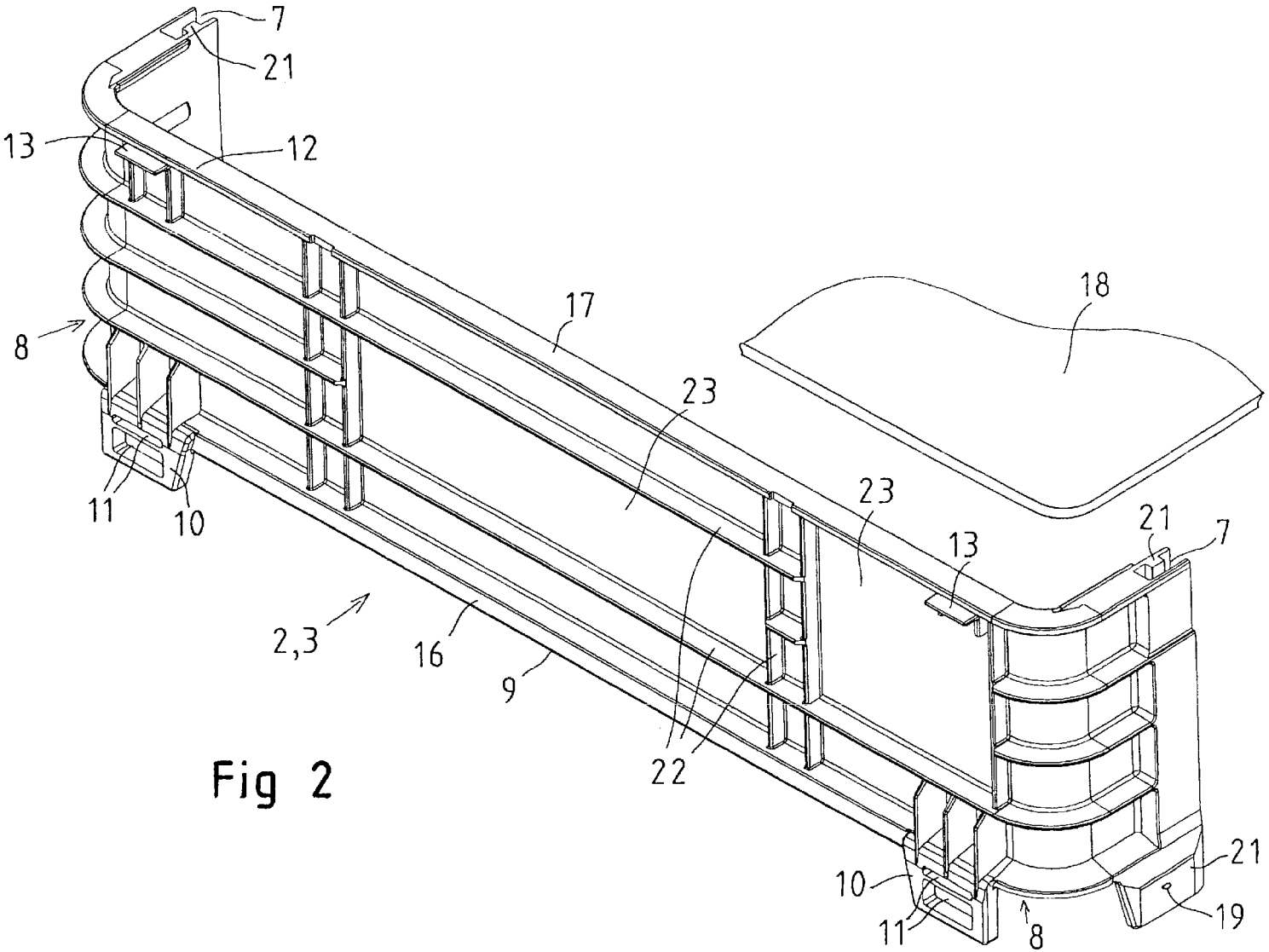
FIG. 2 presents a side wall according to the invention as seen from the outside.
Figure 3:
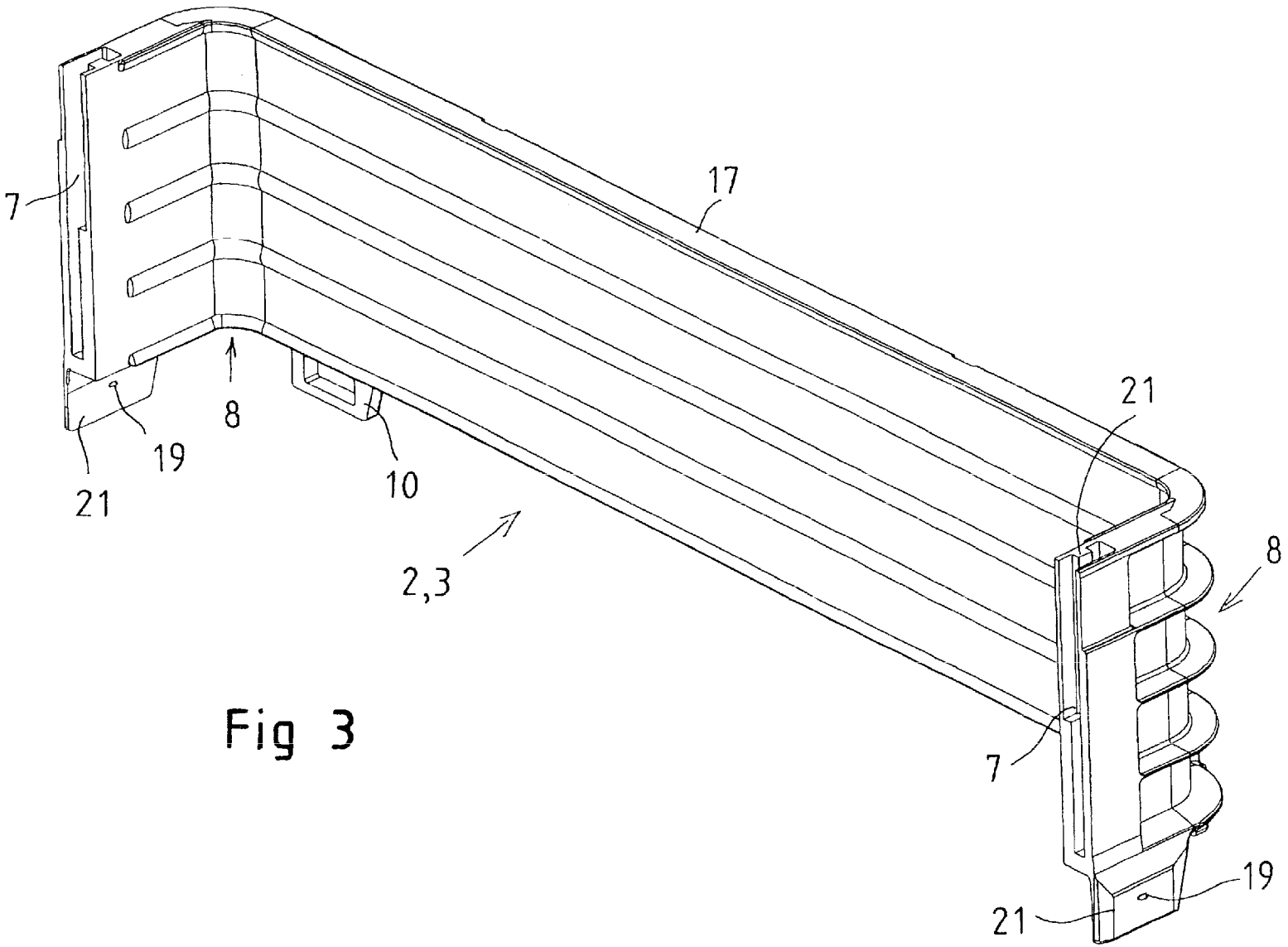
FIG. 3 presents a side wall as shown in FIG. 2, as seen from the inside.
Figure 4:
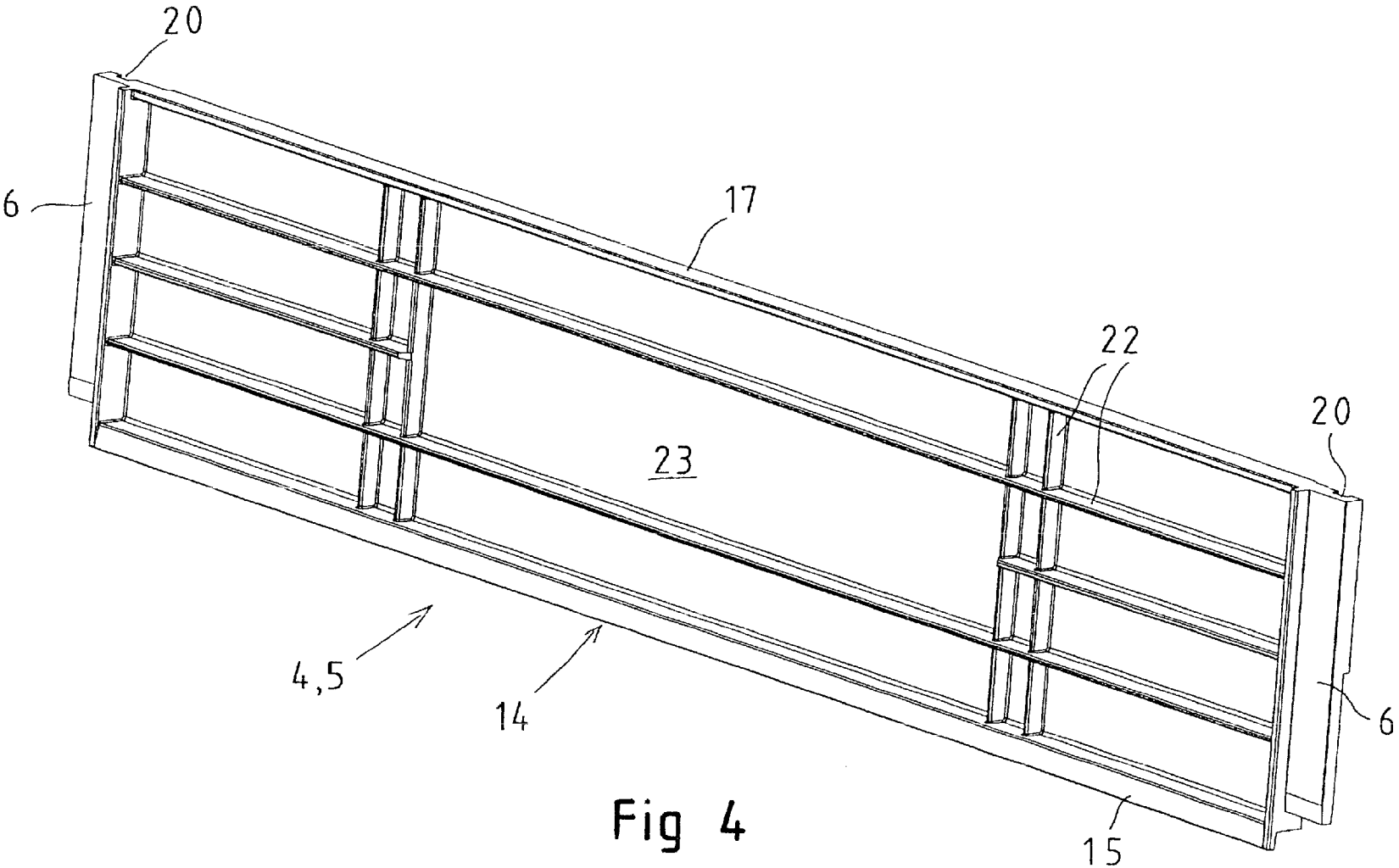
FIG. 4 presents an end wall according to the invention as seen from the outside.
Figure 5:
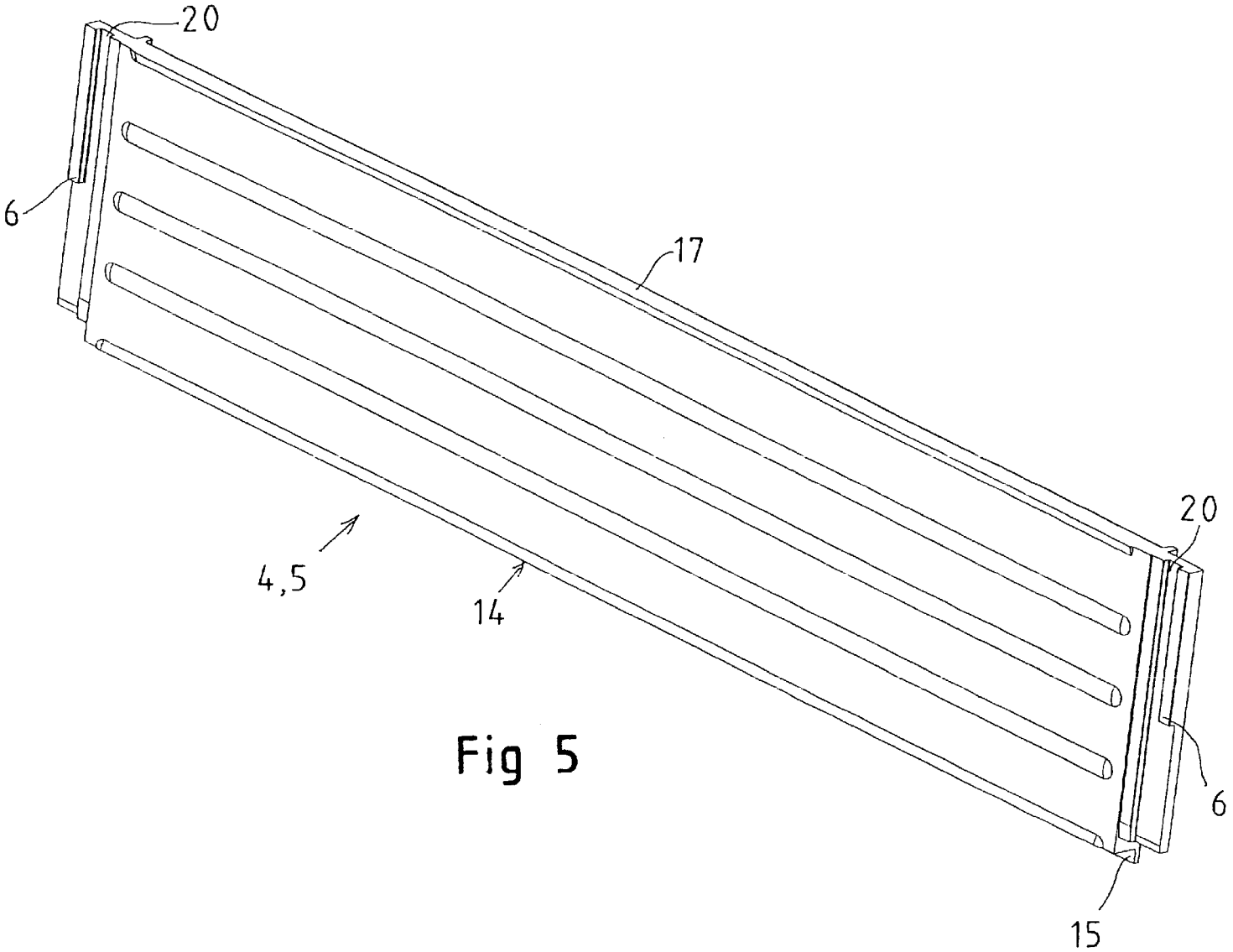
FIG. 5 presents the end wall of FIG. 4 as seen from the inside.

FIGS. 2 and 3 illustrate a side wall 2, 3 as used in the pallet cage of FIG. 1. FIG. 2 shows the side wall as seen from the outside of the cage while FIG. 3 shows the same side wall as seen from the inside of the cage. In a corresponding manner, FIGS. 4 and 5 present the end walls 4, 5 of the pallet cage of FIG. 1, i.e. FIG. 4 shows the outer surface of the end wall while FIG. 5 shows its inner surface.

As illustrated in FIGS. 2 and 3, the side wall 2, 3 comprises a substantially straight and planar plate-like middle section having a length substantially corresponding to the length of that edge of the pallet on which it is to be mounted. Provided at the ends of the middle section are curved corner parts 8 forming transverse extensions of the side wall with a 90° curvature in the same direction, extending through some distance in this direction. In a corresponding manner, the end walls 4, 5 in FIG. 4 and 5 consist of a substantially plate-like and straight body of a rectangular form having the same height as the side wall. The end wall being only a straight and plate-like body, its length is so designed that the combined length of the end wall and the transverse sections of the corner parts of the side walls corresponds to the length of the corresponding edge of the pallet to be used.

The vertical edges of the end walls 4 and 5 are provided with a joining element 6 consisting of a vertical strip provided with a groove 20. The vertical edges of the corner parts 8 are provided with counterparts 7 of the joining elements 6, i.e. vertical spaces having a form substantially corresponding to the form of the joining elements 6. Thus, when a joining element 6 provided with a groove 20 is inserted into the counterpart 7, the groove 20 together with a rib 21 provided in the counterpart 7 and having a form corresponding to the groove 20 will prevent horizontal movements of the side wall and the end wall in relation to each other, thus locking them to each other in the horizontal direction.

Extending downward from the lower edge 9 of the side wall 2, 3 on both sides of its corner part 8 are lugs 10 and 21. The function of the lugs 21 at the edge of the corner part 8 is to hold the side wall steady in its longitudinal direction by connecting it either to the pallet or to a corresponding side wall below it. The lug 21 is provided with a hole 19 to allow the side wall to be fastened to the pallet with a screw or nail.

The downward pointing lugs 10 on the other side of the corner part 8 are designed to hold the side wall in position in its transverse direction. These lugs 10 have two latching sockets 11, i.e. holes, placed one above the other. Placed above the latching sockets in vertical alignment with them are latching clutches 13 located near the upper edge of the side wall and extending outward from it.

The latching clutch 13 is a plate-like tongue of a shape substantially corresponding to the upper latching socket 11 in the lug 10. Thus, when a cage is assembled by placing wall structures one upon the other, a side wall being placed upon another side wall is pushed into position in the lateral direction so that the latching clutch 13 of the lower side wall is inserted into the latching socket 11 in the lug 10 of the upper side wall. After the two opposite side walls have been thus mounted in place, the end walls 4, 5 can be inserted in the vertical direction between them, the side walls and the end walls being thus locked to each other both horizontally and vertically, forming a rigid assembly.

As stated above, the lug 10 comprises two latching sockets 11 placed one above the other. The lower latching socket has a height larger than that of the latching clutch 13 but its width corresponds to the width of the latching clutch. This socket is used if an intermediate floor 18 is used between the wall tiers piled one over the other. Using an intermediate floor 18, the pallet cage can be divided into several compartments in the vertical direction. The larger height dimension of the lower latching socket 11 additionally allows the use of intermediate floors 18 of different thicknesses, depending on the material of the floor and its required bearing capacity. The lower edges 9 and 14 of both the side walls 2, 3 and the end walls 4, 5 are provided with downward pointing angle flanges 15 and 16. The angle flanges together with the lower edge of the wall form a supporting bead forming an angle of 90°, by which bead the walls can be supported on the edges of the pallet or in a corresponding manner on lower side walls and end walls.

The upper edge of both the side wall 2, 3 and the end wall is provided with a substantially horizontal top flange 17, on which the angle flange of the superimposed wall will rest. Thus, the downward pointing angle flanges 15 and 16 of the angle profile will cover the joint between the side walls and end walls placed one upon the other as well as the intermediate floor possibly used between them and provide a downward path for any impurities, splashes and liquids flowing on the outer surface, preventing them from getting inside the cage.

To achieve a light-weight structure, both the side wall and the end wall are made from relatively thin plastic sheet, so their outer surfaces are provided with a sufficient number of vertical and horizontal reinforcing ribs 22 to achieve a given stiffness and strength. Between the reinforcing ribs there are straight and even surface areas 23, which have been left on purpose in order to allow them to be used for the presentation of various information or advertising material.

The inner surfaces of both the side wall and the end wall are also provided with horizontal ribs of a curved cross-section which additionally stiffen the walls. At the upper and lower edges of the walls, these ribs consist of split ribs so that when a wall is placed upon another wall, the split rib at the upper edge of one wall together with the split rib at the lower edge of the other wall will form a complete rib of a curved cross-section. In this way, a pallet cage with an inner surface of an agreeable and continuous appearance is achieved as the joints disappear in the forms of the ribs.

The pallet cage of the invention can be used for the storage and transportation of various goods basically in the same way as prior-art pallet cages. In addition, the pallet cage of the invention can be used in more versatile ways for the storage, transportation of goods and especially for distribution and selling purposes. The pallet cage may have a height of e.g. 10 wall structures placed one upon the other, and one or more of the junctions between wall tiers can be provided with an intermediate floor, the whole assembly remaining coherent in all situations. Thus, it is also possible to form a large container to transport even completely different kinds of goods in separate spaces or goods that are too sensitive to be piled on top of each other, e.g. various bakery products. Besides, it is possible to remove a desired number of the straight end walls from the pallet cage with the pallet cage still remaining coherent. Thus, the pallet cage makes an excellent distribution and selling rack even for retail stores.

Figure 6:
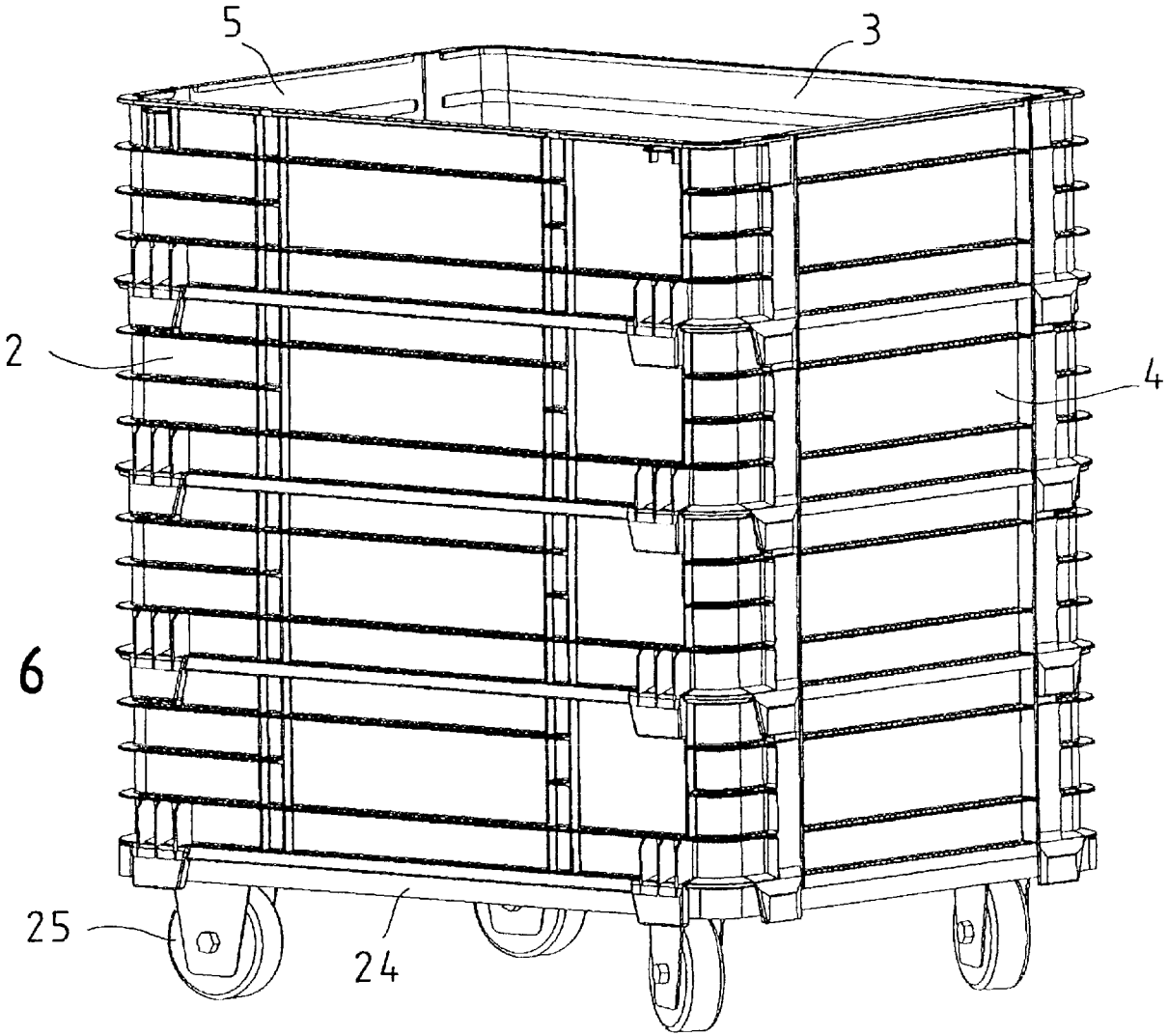
FIG. 6 presents another pallet cage according to the invention.

The pallet cage shown in FIG. 6 comprises a straight, thick and rigid rectangular plate 24 with wheels 25 attached to its lower surface near each corner. Supported on and attached to the pallet thus formed are four tiers of walls consisting of opposite and identical side walls 2,3 and opposite and identical end walls 4,5 in the manner illustrated in FIG. 1.

Figure 7:
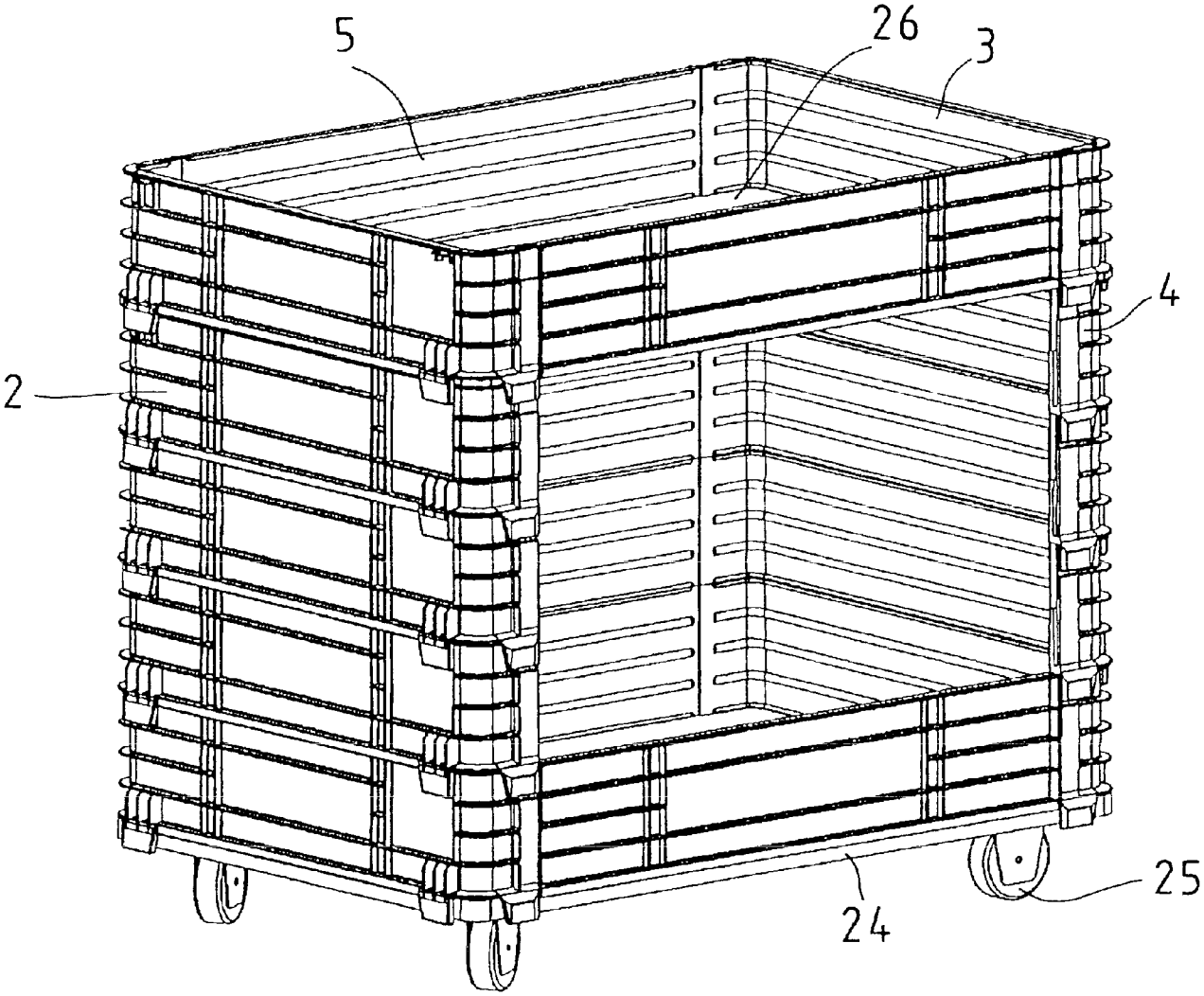
FIG. 7 presents a third pallet cage according to the invention.

Like FIG. 6, FIG. 7 also shows a pallet consisting of a plate 24 and wheels 25. Mounted on it are five tiers of walls, yet with an intermediate floor 26 between the two topmost tiers. In addition, the end walls of the second, third and fourth tiers have been removed. In this way, a box having a height of four wall tiers and one open side and above it a one-tier box open at the top are formed, both boxes being carried by a common pallet.

As described above, pallet cages of different heights can be built as needed in each case. Likewise, they may consist of boxes placed one over the other and boxes open on one side, the height and number of the boxes being freely variable according to need. Thus, the invention replaces various traditional castor pallets consisting of metal cages and racks with sturdy and noiseless pallet cages having an elegant appearance.

In the foregoing, the invention has been described by way of example with reference to the attached drawings while different embodiments of the invention are possible within the scope of the inventive idea defined in the claims.

What is claimed is:

1. A pallet cage, comprising a pallet and four walls mounted on its edges, together forming a cage open above and having the shape of a rectangular parallelopiped;

the four walls of the cage being separate castings pressed from plastic and detached from each other;

two of said walls being opposite and identical side walls while the other two being opposite and identical end walls;

each end wall having an upper edge and a lower edge, and comprising a straight elongated and plate-like part having a joining element at each end thereof;

each side wall comprising a straight elongated and plate-like part having a 90° corner part at each end thereof; the side walls having outer edges which are provided with counterparts of the joining elements;

the walls being connectable to each other by the joining elements and their counterparts to form the walls of a cage having the form of a right-angled parallelogram;

each side wall having a lower edge and an upper edge, and being provided with at least two lugs extending downward from said lower edge for supporting or fastening the side wall to the pallet; and each lug comprising at least one latching socket, and the upper edge of the side wall being provided with a projecting latching clutch corresponding to the latching socket, so that side walls placed one upon the other can be locked to each other in the vertical direction by fitting the latching socket in the lug of an upper side wall around the latching clutch of a lower side wall.

2. The pallet cage according to claim 1, wherein the joining element and its counterpart consist of elements vertically movable with respect to each other and horizontally lockable with respect to each other.

3. The pallet cage according to claim 1, wherein the corner parts have rounded corners.

4. The pallet cage according to claim 1, wherein the corner parts have substantially sharp corners.

5. The pallet cage according to claim 1, wherein the walls comprising castings are made of HD polyethylene.

6. The pallet cage according to claim 1, wherein the number of latching sockets placed one above the other in the lug exceeds the number of latching clutches placed one above the other in the outer surface of the upper edge of the side wall by at least one, allowing the side wall to be locked in at least two height positions above another side wall.

7. The pallet cage according to claim 1, wherein the lower edge of the end wall is provided with an angle flange extending through its essential length to support the end wall on an edge of the pallet or on the upper edge of an end wall therebelow.

8. The pallet cage according to claim 1, wherein the lower edge of the side wall is provided with an angle flange extending through its essential length to support the side wall on the edge of the pallet or on the upper edge of a side wall therebelow.

9. The pallet cage according to claim 1, wherein the upper edge of the end wall and the side wall is provided with a top flange for supporting a side wall or end wall placed thereon.

10. The pallet cage according to claim 9, wherein the pallet cage comprises a plate-like intermediate floor which can be placed against the top flange of the end and side walls to form an intermediate floor or a cover for the pallet cage.

11. The pallet cage according to claim 1, wherein each lug is provided with a hole to allow the lug to be fastened to the pallet with a screw going through said hole.

12. The pallet cage according to claim 1, wherein the pallet is a plate provided with wheels.

* * * * *